US005259328A

United States Patent [19]

Nöltge et al.

[11] Patent Number: 5,259,328

[45] Date of Patent: Nov. 9, 1993

[54] PIPING CUTTER WITH TENSIONING SHOULDERS AND MOVABLE CLAMP HALVES AND KNIVES

[75] Inventors: Thomas Nöltge, Bielefeld; Klaus Möller, Detmold, both of Fed. Rep. of Germany

[73] Assignee: Dürkopp Adler Aktiengesellschaft, Fed. Rep. of Germany

[21] Appl. No.: 892,262

[22] Filed: Jun. 2, 1992

[30] Foreign Application Priority Data

Jun. 3, 1991 [DE] Fed. Rep. of Germany ..... 4118135

[51] Int. Cl.[5] ..... D05B 3/10; B26D 1/04

[52] U.S. Cl. ..... 112/68; 112/70; 112/129; 83/175

[58] Field of Search ..... 112/2, 44, 65–68, 112/70, 114, 122–129, 130, 264.1, 311, 315, 75, 76, 217, 260; 83/18, 175, 374, 423

[56] References Cited

U.S. PATENT DOCUMENTS

| | | | |
|---|---|---|---|
| 3,747,545 | 7/1973 | Nicolay et al. | 112/68 |
| 3,763,802 | 10/1973 | Champney et al. | 112/68 X |
| 3,934,776 | 1/1976 | Cruden, Jr. | 112/65 X |
| 3,980,030 | 9/1976 | Fischer et al. | 112/65 X |
| 4,481,895 | 11/1984 | Asao et al. | 112/68 X |
| 4,589,358 | 5/1986 | Goldbeck et al. | 112/68 |
| 5,109,785 | 5/1992 | Inoue et al. | 112/70 X |

FOREIGN PATENT DOCUMENTS

| | | | |
|---|---|---|---|
| 3930562 | 1/1991 | Fed. Rep. of Germany | 112/68 |
| 0096295 | 5/1985 | Japan | 112/129 |
| 2186891 | 8/1987 | Japan | 112/68 |
| 2-203894 | 8/1990 | Japan | 112/129 |

*Primary Examiner*—Clifford D. Crowder
*Assistant Examiner*—Ismael Izaguirre
*Attorney, Agent, or Firm*—Ostrolenk, Faber, Gerb & Soffen

[57] ABSTRACT

A cutting device for a sewing system having a work table, and a material clamp on the work table for transporting sewing material to a cutting point. The cutting device includes two wedge-shaped knives arranged at the cutting point, for producing gusset cuts in the material, and an elongated opening in the work table for allowing the wedge-shaped knives to pass through the work table to cut the material. The cutting device further includes a clamping device for clamping the material at the cutting point so as to increase the tension in the material and thereby increase the controllability of the location at which the wedge-shaped knives make the gusset cuts. Preferably the camping device which includes two transversely movable clamp halves tightens the sewing material transverse to the direction of transport of the sewing material. Further, a slide plate attached to the surface of the work table includes shoulders or tensioning beads for tensioning the material. Because the material is held taut before the gusset cuts are made, the cuts can be made at well defined points, even in the case of very fine material.

26 Claims, 5 Drawing Sheets

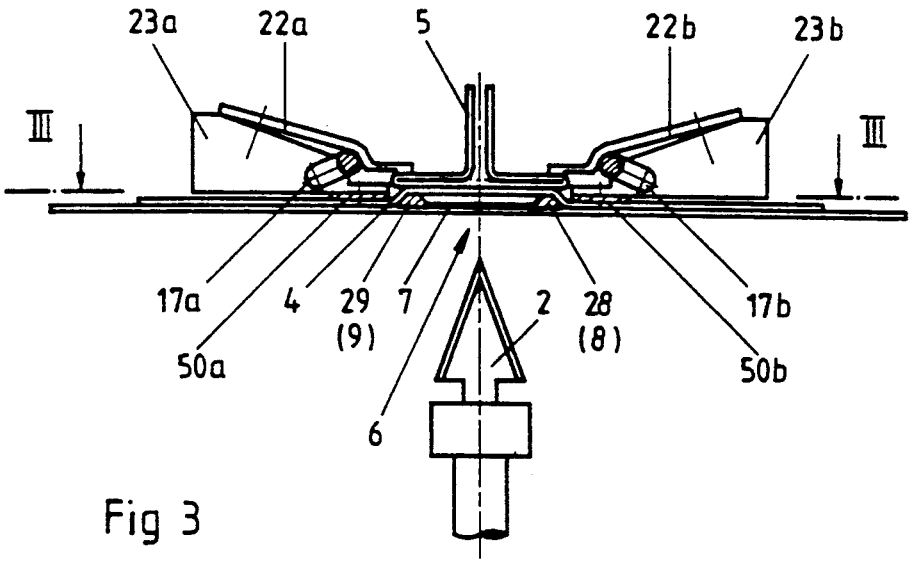
Fig. 2
Fig 3
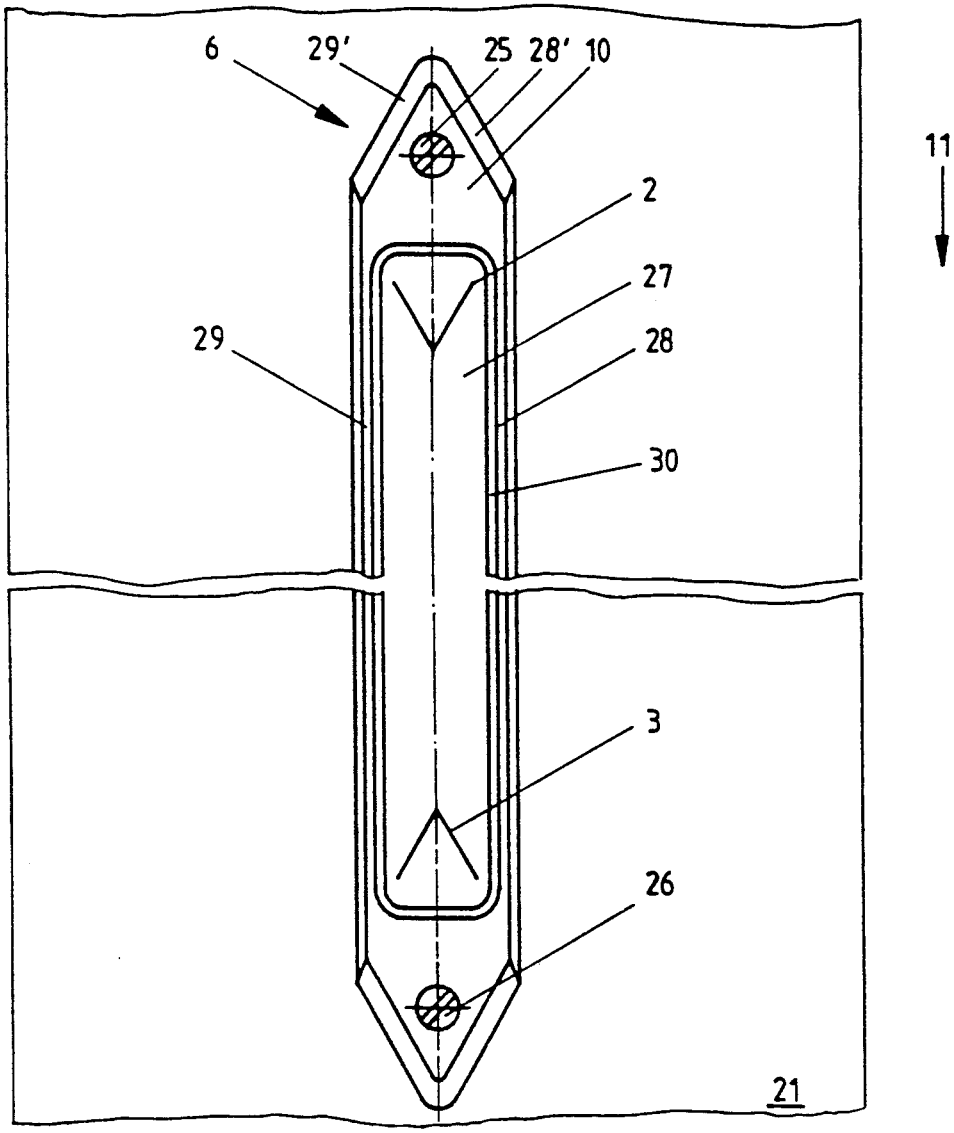

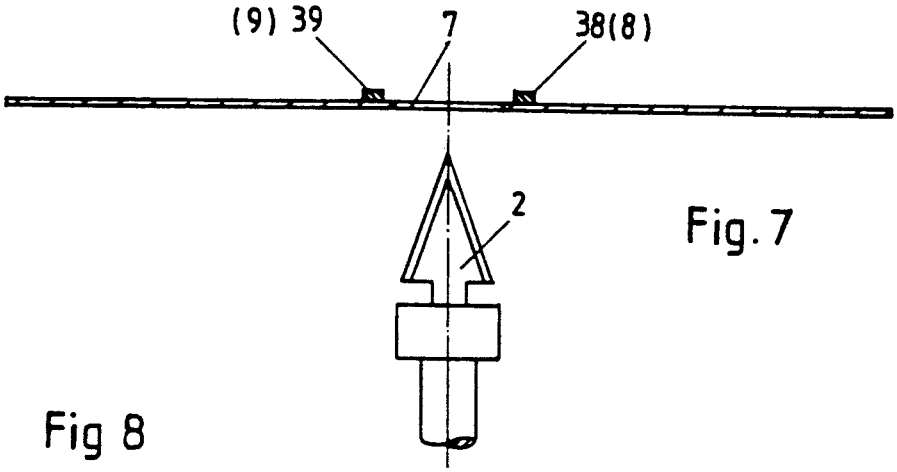
Fig. 7
Fig 8
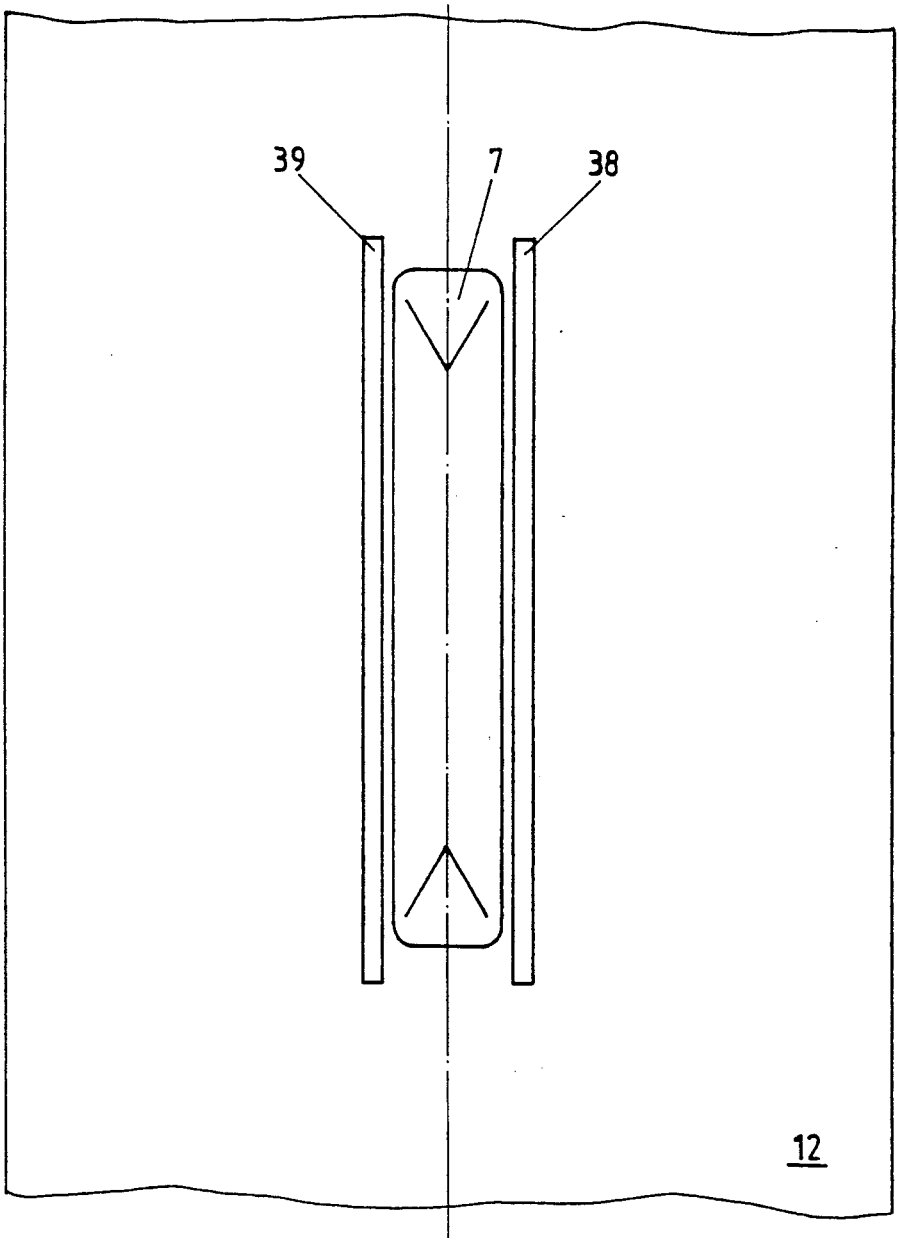

PIPING CUTTER WITH TENSIONING SHOULDERS AND MOVABLE CLAMP HALVES AND KNIVES

BACKGROUND OF THE INVENTION

1. Field of the Invention

The present invention relates to a cutting device for a sewing system of the general type which has a material clamp for transporting the sewing material past the needle, two wedge-shaped knives arranged under the work table at a cutting point downstream from the needle for producing gusset cuts in the material, and a slit-shaped recess in the work table for passage of the wedge-shaped knives.

The invention relates more particularly to a device for providing more reliable clamping of the sewing material while the gusset cuts are being made, to provide better control over the locations of the gusset cuts.

The invention may also stretch or tension the material transversely to the direction in which it is transported by the material clamp.

2. Background Art

Devices for producing cuts at the ends of pocket cuts, particularly in the case of piped pocket cuts, are known from U.S. Pat. No. 4,341,169 and Federal Republic of Germany Patent 34 04 758 (which corresponds to U.S. Pat. 4,589,358). All prior art materials mentioned herein are expressly incorporated by reference.

At a feed station, the piping strip is placed mechanically on the material being sewn. A fabric clamp descends onto the piping strip and clamps it onto the material being sewn. The two parts are then brought to the sewing point where the piping strip is sewn to the material by means of a double-needle sewing machine. At the same time, the pocket opening is cut by means of a knife arranged between the two needles.

At a cutting point downstream from the sewing point, two wedge-shaped knives are arranged below the work table, and after the sewing operation is completed, the wedge-shaped knives make gusset cuts at the ends of the lengthwise cut. These gusset cuts are necessary so that the pocket opening of the finished article of clothing does not develop folds caused by several superimposed layers of material.

Since the wedge-shaped knives move upward past the top of the work table, it is difficult to locate the cuts at a reproducible place, in the case of thin material. Due to its elasticity, the material is pushed away from the work table before it is cut to a greater or lesser extent, by the upward movement of the knives.

SUMMARY OF THE INVENTION

The main object of the present invention is, therefore, to improve a cutting device of the aforementioned type in such a manner that dependable gusset cuts can be produced, even in thin material.

A more particular object is to provide more reliable clamping so as to tension the sewing material while the gusset cuts are being made, so that the gusset cuts can be made at more predictable locations.

These and other objects are achieved in a cutting device of this type, by providing a device on the work table, for improving the clamping of the material above the knives.

By tensioning the material transverse to the direction of transport before the production of the gusset cut, the evasive movement of the material that is possible due to the elasticity of the material is greatly restricted.

According to one aspect of the invention, the device may include at least two ledges or shoulders which form an elevated portion of the work table and extend in the longitudinal direction parallel to, and on both sides of, the recess provided for passage of the knives through the work table. An advantage of this feature is that it is simple and inexpensive to retrofit or supplement an already existing sewing system.

According to another aspect of the invention, the device may include a frame which is fastened on the work table and forms an elevation, the frame surrounding the recess in the work table. Such a clamping device has a single part, so mounting is simple.

In yet another aspect of the invention, a slide plate may be mounted on the work table, which has upwardly directed beads on the longitudinal edges of the recess. This feature is easy to achieve from a manufacturing standpoint.

In another form of the invention, the material clamp may have two material clamp halves, and the material clamp halves may be displaceable in opposite directions to each other transverse to the direction of transport, when the material has been clamped thereto for forming the gusset cuts. This further feature of the invention makes it possible, by variably controlling the displacement of the material clamp halves, to adapt the tension to be produced in the material to its elasticity. In this way, different materials can always be cut with the same reproducibility.

BRIEF DESCRIPTION OF THE DRAWINGS

Other objects, features, and advantages of the invention will be explained below in further detail with reference to the drawings, in which:

FIG. 2 is a sectional view taken along the line II—II in either FIG. 1 or FIG. 3;

FIG. 3 is a top view, as seen in the direction indicated by the arrow III in FIG. 1;

FIG. 7 is a cross-sectional view of a fourth embodiment of the invention; and FIG. 8 is a plan view of the embodiment of FIG. 7.

DETAILED DESCRIPTION OF THE PREFERRED EMBODIMENT

Figure 1:
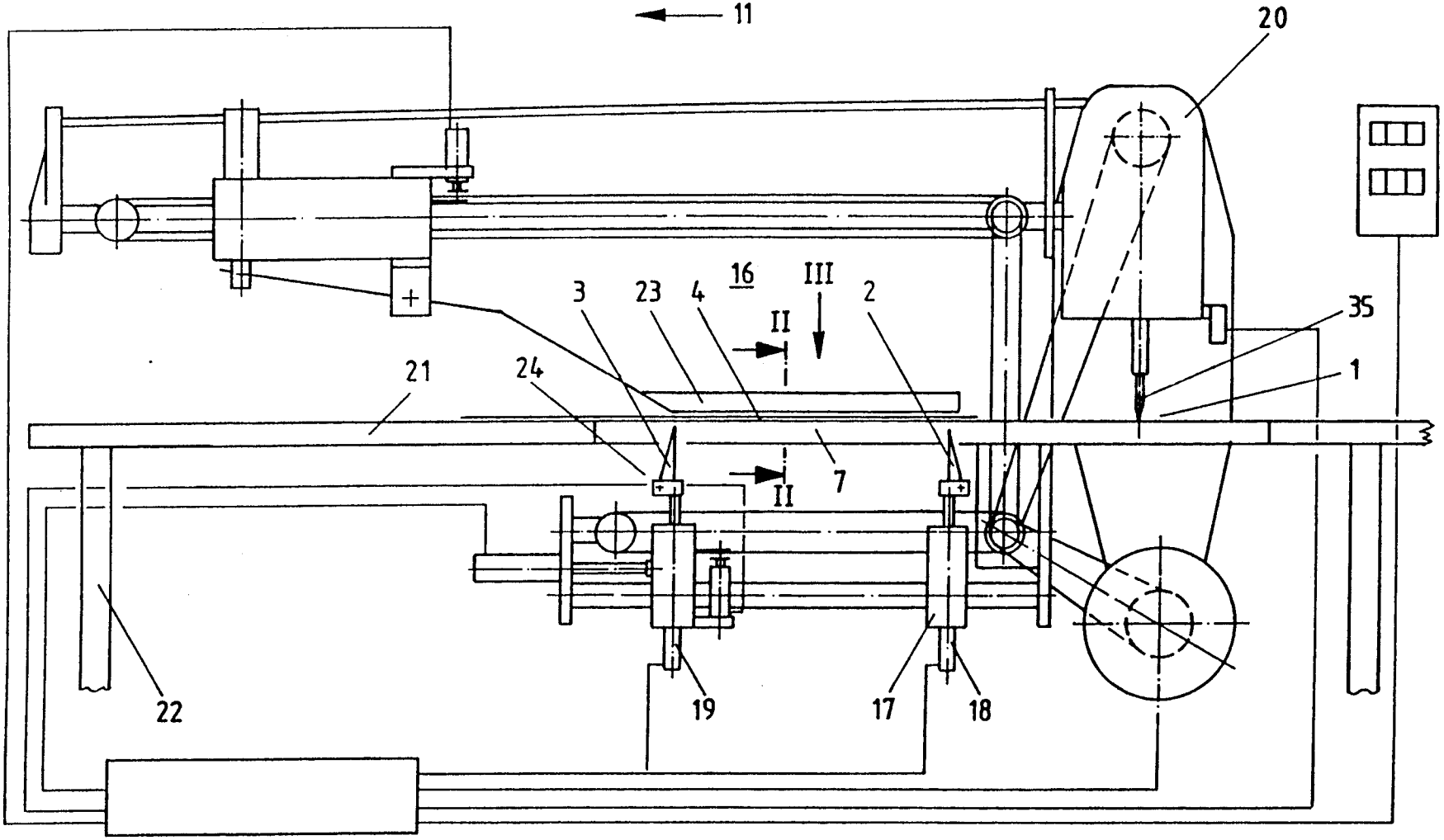
FIG. 1 is a diagrammatic front view of a sewing system incorporating a first embodiment of the invention.

The main components of the sewing system shown in FIG. 1 are sold by the assignee under the type designation "Class 745." The system includes a conventional double-needle sewing machine 20 which has a vertical cutting knife arranged between the sewing needles 35, mounted on a frame 22. The sewing system has a horizontally displaceable material clamp 23 which transports individual pieces of material 4, 5 from a feed position in front of the sewing point 1 (toward the right in FIG. 1) to the cutting position behind the sewing point 1.

The cutting device 24 includes one wedge-shaped knife 2 which is mounted on a bearing pedestal 17. The bearing pedestal 17 is fixed in space and the knife 2 is displaceable in the vertical direction when a respective cylinder 18 is acted on by pressure fluid. The cutting device 24 also includes another wedge-shaped knife 3, which is also displaceable vertically, when a respective cylinder 19 is acted on by pressure fluid. The work table 21 has a recess 7 through which the wedge knives 2, 3 can pass upward, so that they can make gusset cuts in the material 4.

The system of FIG. 1 incorporates a first embodiment of the invention which is shown in more detail in FIG. 2. The material clamp 23 has two material clamp halves 23*a*, 23*b* and clamping plates 22*a* and 22*b* arranged respectively on the material clamp halves 23*a*, 23*b*. The clamping plates are driven for being swung in the vertical direction in a known manner, not shown in detail here, via the cams 17*a*, 17*b*, so that the material clamps 23 can be opened and closed. The bottom of the material clamp 23 rests on the material 4. Between the material clamp halves 23*a*, 23*b*, the piping strip 5 is placed on the material 4 and fixed there by the clamping plates 22*a*, 22*b*. Both parts, namely the material 4 and the piping strip 5 placed on it, are transported to the sewing point 1 below the needles 35, where the piping strip 5 is sewn to the material 4 and the pocket opening is cut by the knife (not shown) arranged between the needles 35, and then to the cutting point behind the needles 35.

At the cutting point, a clamping device 6, for clamping the material 4 so as to tension the material transversely to the direction of transport 11, is provided on the work table 21 at the level of the recess 7, through which the knives 2, 3 pass upward.

As seen in FIGS. 2 and 3, the clamping device 6 includes a frame 10. The frame 10 includes a sheet-metal strip having a thickness of about 1.5 to 2.5 mm. A thickness of 1.5 mm has been used successfully. The width of the frame 10 is selected so that the frame 10, when the material clamp 23 passes it, lies between the material clamp halves 23*a*, 23*b* and below the clamping plates 22*a*, 22*b*. The front and rear ends of the frame 10 form acute angles. In the center, the sheet-metal strip is provided with a milled opening 27 which corresponds in its longitudinal and transverse size to the recess 7 in the work table 21. The frame 10 is screwed firmly onto the work table 21 by screws 25, 26. At the ends of the frame, there are surrounding bevels 28', 29'. Similarly, the transition from the frame to the milled opening 27 is also bevelled, at least in the longitudinal direction, as shown at 30.

The arms 28, 29 of the frame 10 form an elevation above the surface of the work table 21. When the material 4 is pulled over the frame 10 by the material clamp 23, it travels onto and over the front end of the frame 10 and is clamped there, between the clamping plates 22*a*, 22*b* and the arms 28, 29. When the material 4 and the piping strip 5 lie fully over the cutting point, the knives 2, 3 are activated in the known manner and the cuts are effected. The clamping of the material 4 over the frame 10 eliminates the elasticity of the fabric, preventing the material 4 from moving away from the knives 2, 3.

Figure 4:
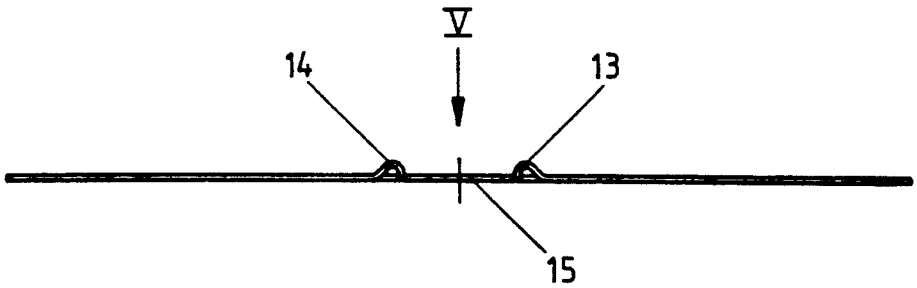
FIG. 4 is a cross sectional view of a second embodiment of the invention.
Figure 5:
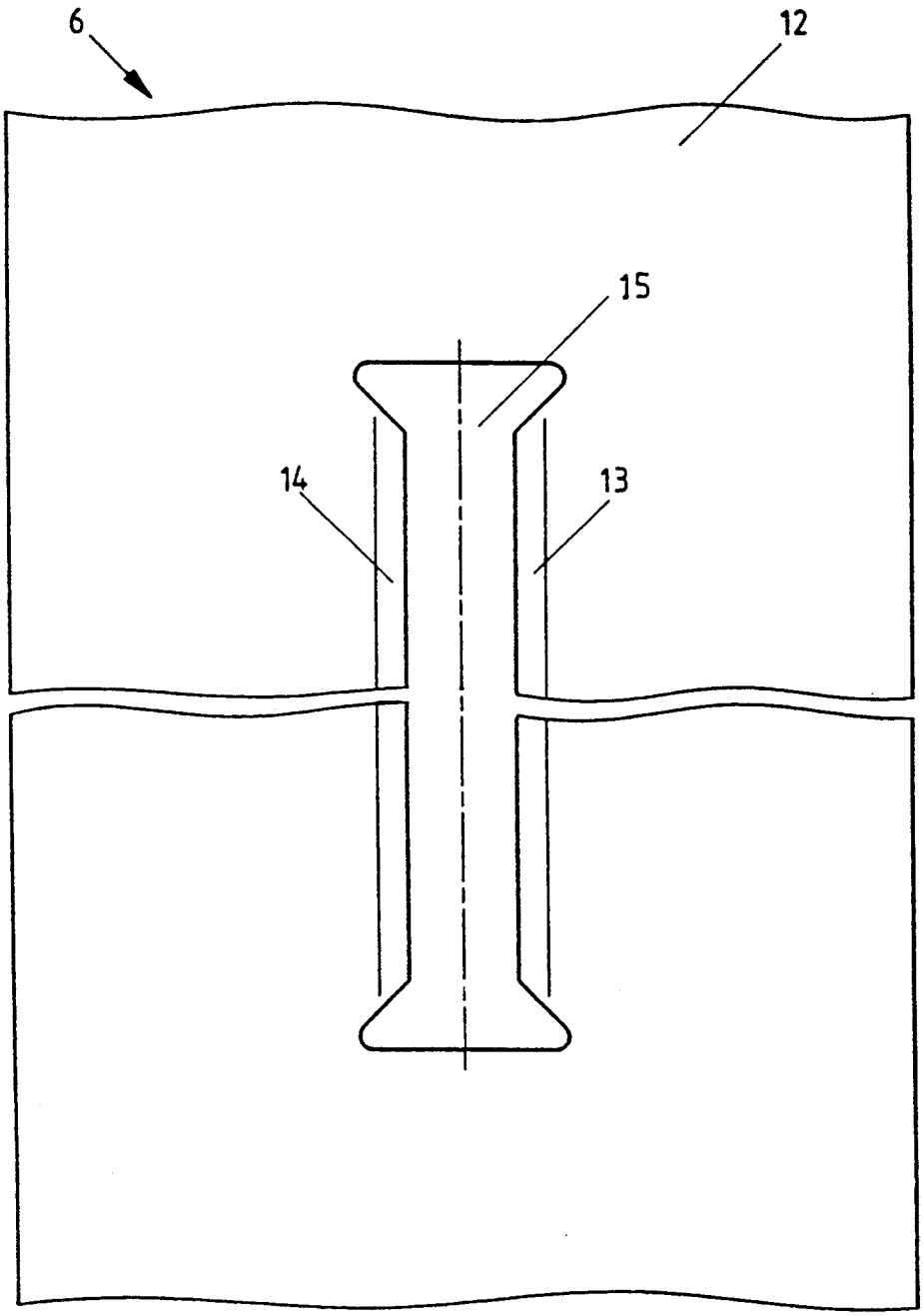
FIG. 5 is a top view, as seen in the direction indicated by the arrow V in FIG. 4.

A second embodiment of the invention is shown in FIGS. 4 and 5. A slide plate 12 can be located on the work table 21 and, due to its smooth surface, provides a low coefficient of friction for the material 4. The slide plate material may be sheet metal 0.5 mm thick. The slide plate 12 has beads 13, 14 on either side of an opening 15, which lies over the recess 7 of the work table 21. The slide plate 12 is fastened to the work table 21, for instance by being screwed to it. The dimensions of the opening 15 correspond to those of the recess 7 provided in the work table 21. The beads which extend in the longitudinal direction of the slide plate 12 along the opening 15 protrude upward above the slide plate 12, whereby shoulders (similar to the shoulders 8, 9 in FIG. 2) are formed.

The absolute height of the arms 28, 29 in FIGS. 2 and 3, and the beads 13, 14 of the slide plate 12 in FIGS. 4, 5, is dependent on the material actually being worked, and on its stretchability. In practice, a few millimeters (e.g., about 1.2–2.5 mm) has already proven to be very effective, and 1.2–1.5 mm is especially preferred.

Figure 6:
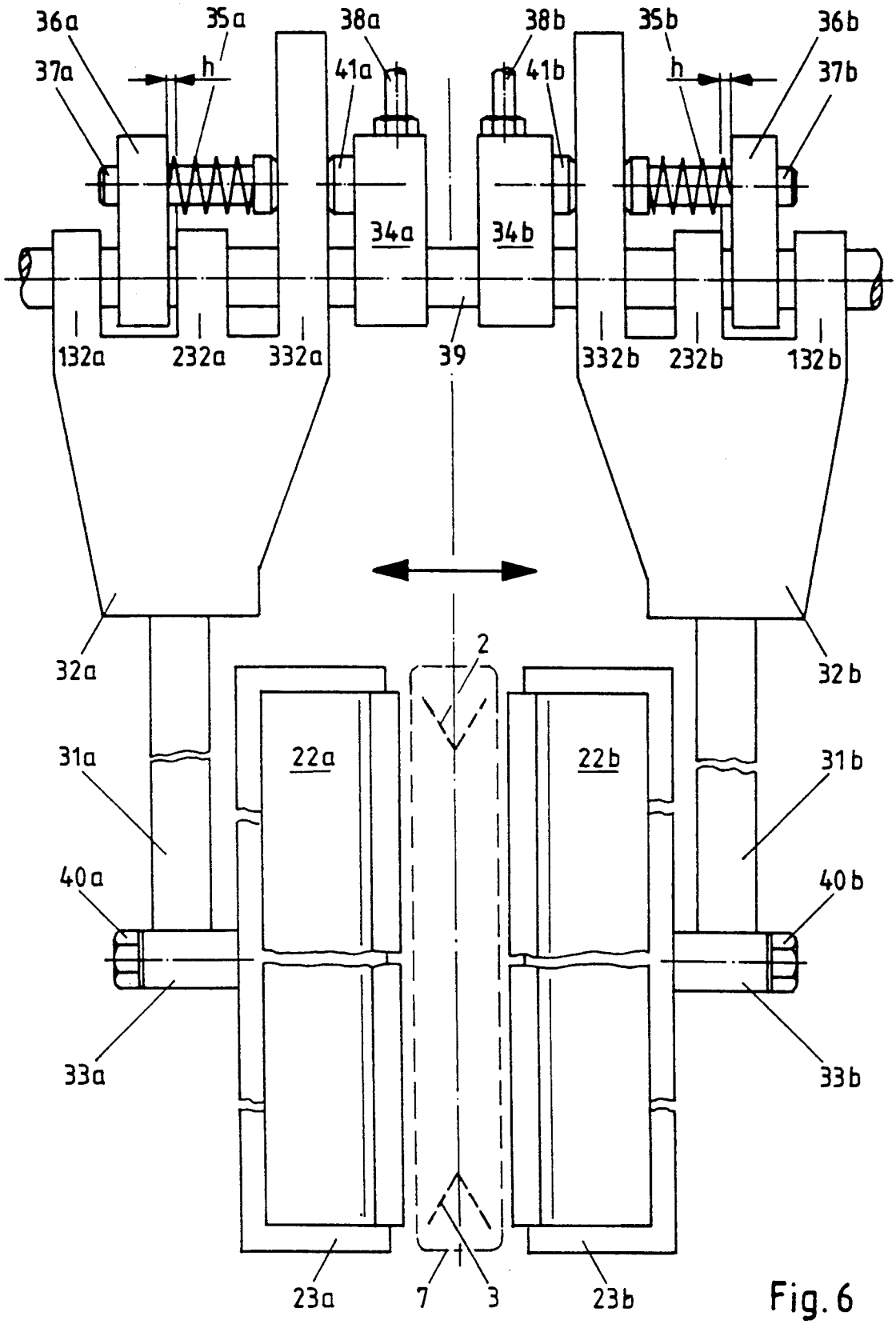
FIG. 6 is a schematic plan view showing a third embodiment of the invention.

As schematically illustrated in FIG. 6, in a third embodiment of the invention, the two clamp halves 23*a* and 23*b* of the material gripper are secured by screws 40*a* and 40*b* to holders 31*a* and 31*b* on gripper arms 32*a* and 32*b*. Components 31*a*, 31*b*, 32*a*, and 32*b* are basically identical and differ only in their symmetry. The ends of the gripper holders 31*a* and 31*b* facing the clamp halves 23*a* and 23*b* have respective eyes 33*a* and 33*b* that are hollow, although that feature is not illustrated, and accordingly constitute sleeves that allow the gripper 23 to pivot. Arms 32*a* and 32*b* have comb-like fingers 132*a*, 232*a*, 332*a*; and 332*b*, 232*b*, 132*b*. Each finger accommodates a bore extending across the direction of travel. The fingers advance arms 32*a* and 32*b* along shaft 39 transversely to the direction of travel. There is a curb 36*a* between fingers 132*a* and 232*a* and another curb 36*b* between fingers 232*b* and 132*b*. A pin 37*a* and 37*b* surrounded by a compression spring 35*a* and 35*b* slides transversely back and forth in each curb 36*a* and 36*b*. Pins 37*a* and 37*b* rest against the fingers 332*a* and 332*b* on arms 32*a* and 32*b*. Associated with each arm 32*a*, 32*b* is a pneumatic cylinder 34*a*, 34*b* that can be supplied with compressed air through lines 38*a* and 38*b*. Pistons 41*a* and 41*b* operate in conjunction with the cylinders 34*a*, 34*b* and act on the surface of fingers 332*a* and 332*b* that face pins 37*a* and 37*b*. When cylinders 34*a* and 34*b* are charged, pistons 41*a* and 41*b* force arms 32*a* and 32*b* transversely to the direction of travel to the same extent. The maximal stroke h is determined by how far fingers 232*a* and 232*b* are from curbs 36*a* and 36*b*.

With this embodiment, the material 4 over opening 7 can now be stretched by the rubber coating 50*a* and 50*b* (see FIG. 2) cemented to the bottom of each gripper half 23*a*, 23*b* transversely to the direction of travel as the result of adhesion. Cylinders 34*a* and 34*b* can be charged in such a way as to adjust the distance the gripper halves 23*a* and 23*b* have to travel to produce the tension to the elasticity of material 4, which can be determined empirically. Curbs 36*a* and 36*b* can be positioned on shaft 39 where they will limit stroke h and prevent even the most delicate material from being stretched too extensively.

In this connection, it is of course advantageous to make certain by suitable measures that a secure connection is maintained between the material clamp 23 and the material 4 or piping strip 5. For this purpose, a coating with a high coefficient of friction can be applied to the bottoms of the material clamp halves 23*a*, 23*b*, as at 50*a* and 50*b* in FIG. 1.

Alternatively, for example if the grip of the friction coating is not strong enough, rows of needles can be provided, which, in their position of rest, are contained within the material clamp halves 23*a*, 23*b*, and which have a working position in which they are moved outward and therefore engage the sewing material beside the recess 7 in the work table 21. Such rows of needles are already known, for instance, for use in a gripper which is part of the known sewing system, as disclosed in U.S. Pat. No. 5,085,158.

A fourth embodiment of the invention is shown in FIGS. 7 and 8. The device 6 can be simply formed of two ledges or strips 37, 38 which are arranged on both sides of the recess 7 in the longitudinal direction on the work table 21 and form elevations which protrude upward with respect to the work table 21. This embodiment is simpler than the embodiment of FIGS. 2 and 3, which includes the frame 10.

Although illustrative embodiments of the invention have been described herein, the scope of the claimed invention is not limited to such embodiments, but rather extends to all modifications, variations, and equivalents that fairly fall within the teachings of this disclosure.

What is claimed is:

1. A cutting device for a sewing system having a work table and a movable material clamp on the work table for clamping and transporting sewing material in a direction towards a cutting point, comprising:

two wedge-shaped knives movably disposed at the cutting point for producing gusset cuts in the material, and an opening in the work table for the passage therethrough of the wedge-shaped knives to cut the material; and means for tensioning the material at the cutting point to control the location in the material at which the wedge-shaped knives make the gusset cuts, wherein the tensioning means includes an elevated portion on the work table which increase the tension in the material in a direction transverse to the direction in which the material clamp transports the material.

2. The cutting device of claim 1, wherein the wedge-shaped knives are movably disposed under the work table and move upward to cut the sewing material.

3. The cutting device of claim 1, wherein the tensioning means limits the stretching of the material when the knives make the gusset cuts.

4. A cutting device for a sewing system having a work table and a movable material clamp on the work table for clamping and transporting sewing material in a direction towards a cutting point, comprising:

two wedge-shaped knives movably disposed at the cutting point for producing gusset cuts in the material, and an opening in the work table for the passage therethrough of the wedge-shaped knives to cut the material; and means for tensioning the material at the cutting point to control the location in the material at which the wedge-shaped knives make the gusset cuts, wherein the tensioning means increases the tension in the material in a direction transverse to the direction in which the material clamp transports the material; and wherein the material clamp includes two material clamp halves, the material clamp halves being displaceable in opposite directions from each other transverse to the direction of transport; and holding means for holding the sewing material to both of the material clamp halves, thereby increasing the tension in the sewing material when the material clam halves are displaced from each other.

5. The cutting device of claim 4, wherein said holding means includes a high-friction coating disposed on surfaces of each of the material clamp halves.

6. The cutting device of claim 4, wherein said holding means includes a gripper connected with each of the material clamp halves.

7. A cutting device for a sewing system having a work table and a movable material clamp on the work table for clamping and transporting sewing material in a direction towards a cutting point, comprising:

two wedge-shaped knives movably disposed at the cutting point for producing gusset cuts in the material, and an opening in the work table for the passage therethrough of the wedge-shaped knives to cut the material; and means for tensioning the material at the cutting point to control the location in the material at which the wedge-shaped knives make the gusset cuts, wherein the tensioning means increases the tension in the material in a direction transverse to the direction in which the material clamp transports the material, and limits the stretching of the material when the knives make the gusset cuts;

wherein the tensioning means includes a frame which is fastened to the work table and forms an elevation adjacent the opening in the work table.

8. The cutting device of claim 7, wherein the elevation projects approximately 1.2 to 1.5 mm above the top of the work table.

9. The cutting device of claim 7, wherein the frame surrounds the opening.

10. The cutting device of claim 7, wherein the frame has a pair of arms which extend longitudinally on either side of the opening, said pair of arms forming the elevation.

11. A cutting device for a sewing system having a work table and a movable material clamp on the work table for clamping and transporting sewing material in a direction towards a cutting point, comprising:

two wedge-shaped knives movably disposed at the cutting point for producing gusset cuts in the material, and an opening in the work table for the passage therethrough of the wedge-shaped knives to cut the material; and means for tensioning the material at the cutting point to control the location in the material at which the wedge-shaped knives make the gusset cuts, wherein the tensioning means increases the tension in the material in a direction transverse to the direction in which the material clamp transports the material, and limits the stretching of the material when the knives make the gusset cuts;

wherein the tensioning means includes a slide plate which is mounted on the work table and has upwardly directed beads disposed along longitudinal edges of the opening, said beads forming elevations adjacent the opening, wherein the beads increase the tension in the material when the material is clamped by the material clamp for cutting the gusset cuts.

12. The cutting device of claim 11, wherein the elevations project approximately 1.2 to 1.5 mm above the top of a work table.

13. A method of forming gusset cuts in a sewing material with a sewing system having a work table with an opening and a movable clamp located on the work table, comprising the steps of:

clamping the material with the material clamp;

transporting the material clamp and the material in a direction toward a cutting point, wherein two wedge-shaped knives are movably disposed at the cutting point;

tensioning the material by providing elevations on the work table at the cutting point which stretch the material;

moving the wedge-shaped knives upward through the opening towards the stretched material;

producing gusset cuts in the stretched material; and limiting the stretching in the material when the wedge-shaped knives make the gusset cuts to increase the controllability of the location at which the gusset cuts are made, by increasing the tension in the material in a direction transverse to the direction in which the material clamp transports the material.

14. The cutting device of claim 13, wherein the elevations project approximately 1.2–1.5 mm from the surface of the work table.

15. The method of claim 13, wherein the step of providing elevations further comprises the step of forming at least two shoulders on the work table, the shoulders extending in a longitudinal direction parallel to and on both sides of the opening in the work table.

16. The method of claim 13, wherein the step of providing the elevations further comprises the step of mounting a frame on the work table, the frame having raised arms which form the elevations adjacent the opening in the work table.

17. The method of claim 13, wherein the step of providing the elevations further comprises the step of mounting a slide plate on the work table, the slide plate including upwardly directed beads disposed along the longitudinal edges of the opening to form the elevations adjacent the opening and increasing the tension in the material when the material clamp clamps the sewing material to the work table for forming the gusset cuts.

18. A method of forming gusset cuts in a sewing material with a sewing system having a work table with an opening and a movable clamp located on the work table comprising the steps of:

clamping the material with the material clamp;

transporting the material clamp and the material in a direction toward a cutting point, wherein two wedge-shaped knives are movably disposed at the cutting point;

tensioning the material at the cutting point to stretch the material;

moving the wedge-shaped knives upwards through the opening towards the stretched material;

producing gusset cuts in the stretched material; and limiting the stretching in the material when the wedge-shaped knives make the gusset cuts to increase the controllability of the location at which the gusset cuts are made, by increasing the tension in the material in a direction transverse to the direction in which the material clamp transports the material;

wherein the step of tensioning the material comprises the steps of:

providing the material clamp with two movable material clamp halves, the material clamp halves being displaceable in opposite directions from each other in the direction transverse to the direction of transport;

clamping the sewing material with both of the material clamp halves; and moving the material clamp halves apart before forming the gusset cuts, thereby increasing the tension in the sewing material when the material clamp halves are displaced from each other.

19. A cutting device for a sewing system having a work table and a movable material clamp located on the work table for clamping and transporting a sewing material in a direction towards a cutting point, comprising:

two wedge-shaped knives movably disposed at the cutting point for producing gusset cuts in the material, and an opening in the work table, said wedge-shaped knives passing through the opening to produce the gusset cuts in the material; and means for tensioning the material at the cutting point to control the location at which the wedge-shaped knives produce the gusset cuts in the material, the tensioning means comprising a frame fastened to the work table, said frame forming an elevation adjacent the opening.

20. The cutting device of claim 19, wherein the tensioning means includes at least two shoulders which form the elevation on the work table and extend in a longitudinal direction parallel to and on both sides of the opening in the work table.

21. The cutting device of claim 19, wherein the tensioning means tensions the material in a direction transverse to the direction in which the material is transported.

22. A cutting device for a sewing system having a work table and a movable material clamp located on the work table for clamping and transporting a sewing material in a direction towards a cutting point, comprising:

two wedge-shaped knives movably disposed at the cutting point for producing gusset cuts in the material, and an opening in the work table, said wedge-shaped knives passing through the opening to produce the gusset cuts in the material; and means for tensioning the material at the cutting point to control the location at which the wedge-shaped knives produce the gusset cuts in the material, the tensioning means comprising a slide plate mounted on the work table, the slide plate including upwardly directed beads disposed along longitudinal edges of the opening, said beads forming elevations adjacent the opening, the elevations increasing the tension in the material when the material is clamped by the material clamp for cutting the gusset cuts.

23. The cutting device of claim 22, wherein the tensioning means tensions the material in a direction transverse to the direction in which the material is transported.

24. A cutting device for a sewing system having a work table and a movable material clamp located on the work table for clamping and transporting a sewing material in a direction towards a cutting point, comprising:

two wedge-shaped knives movably disposed at the cutting point for producing gusset cuts in the material, and an opening in the work table, said wedge-shaped knives passing through the opening to produce the gusset cuts in the material; and means for tensioning the material at the cutting point to control the location at which the wedge-shaped knives produce the gusset cuts in the material, the tensioning means comprising at least two shoulders forming an elevated portion on the work table, said elevated portion extending in a longitudinal direction parallel to and on both sides of the opening.

25. The cutting device of claim 24, wherein the elevated portion projects approximately 1.2 to 1.5 mm above a top of the work table.

26. The cutting device of claim 24, wherein the tensioning means tensions the material in a direction transverse to the direction in which the material is transported.

* * * * *